United States Patent [19]

Young

[11] Patent Number: 4,840,478

[45] Date of Patent: Jun. 20, 1989

[54] METHOD AND ARTICLE OF MANUFACTURE FOR INSERTING CONTACT LENS

[76] Inventor: Sidney F. Young, 355 N. Wilmot Rd., Tucson, Ariz. 85711

[21] Appl. No.: 156,341

[22] Filed: Feb. 16, 1988

Related U.S. Application Data

[62] Division of Ser. No. 853,651, Apr. 18, 1986, Pat. No. 4,757,571.

[51] Int. Cl.[4] ..... G02C 7/04

[52] U.S. Cl. ..... 351/177

[58] Field of Search ..... 351/160 R, 160 H, 161, 351/162, 177

[56] References Cited

U.S. PATENT DOCUMENTS

| | | | |
|---|---|---|---|
| 587,243 | 7/1897 | Sloan . | |
| 1,924,337 | 8/1933 | Troupa | 15/188 |
| 2,186,005 | 1/1940 | Casto | 15/167 |
| 2,464,321 | 3/1949 | Konczal | 15/167 |
| 2,695,416 | 11/1954 | Raimo | 15/106 |
| 3,031,918 | 5/1962 | Moyers | 351/160 R |
| 3,132,887 | 5/1964 | Martinez | 351/160 R |
| 3,354,492 | 11/1967 | Baumgartner | 15/167 |
| 3,490,806 | 1/1970 | Lopez-Callaja et al. | 351/160 R |
| 3,681,806 | 8/1972 | Han | 15/105 |
| 3,744,078 | 7/1973 | Vallis | 15/167 |
| 3,843,991 | 10/1974 | Vallis | 15/167 |
| 4,050,825 | 9/1977 | Stein | 401/19 |

FOREIGN PATENT DOCUMENTS

| | | |
|---|---|---|
| 249610 | 4/1948 | Switzerland . |
| 5223 | of 1912 | United Kingdom . |
| 678406 | 9/1952 | United Kingdom . |

*Primary Examiner*—John K. Corbin
*Assistant Examiner*—Scott J. Sugarman
*Attorney, Agent, or Firm*—Charles E. Cates

[57] ABSTRACT

The specification teaches a method of applying contact lenses to human eyes by sensitizing the fingers and applying the lenses to the eyes by sense of touch. Also taught are several preferred embodiments of means for sensitizing and cleaning the fingers with water only and without a cleaning chemical or doing a thorough job with only the use of minimal chemical solvents, such as soap, wherein a base having two faces provided with abrasion means, e.g., brush bristles or nylon fiber pod, preferably trough shaped and with means for gripping the base, are provided.

6 Claims, 1 Drawing Sheet

METHOD AND ARTICLE OF MANUFACTURE FOR INSERTING CONTACT LENS

This is a division of co-pending application Ser. No. 06/853,651, filed Apr. 18, 1986, now U.S. Pat. No. 4,757,571 pursuant to requirement for restriction and election made by the Examiner in that case.

This invention relates to a method of inserting a contact lens in the human eye and to an improved article of manufacture useful in the method.

Continuing problems in the use of contact lenses are the wearer's tendency to do an inadequate job of cleaning the lenses (because of the exacting standards of cleanliness required in the process of cleaning the lenses especially when cleaning and insertion are attempted in locations outside the home where ideal conditions are not present), and the difficulty in applying the lenses to the eyes.

BRIEF SUMMARY OF THE INVENTION

I have discovered that two related objectives can be attained by means of the method of this invention by using the step of sensitizing the wearer's fingers, preferably by abrasion and preferably in conjunction with the use of the article of manufacture which is also the subject of this specification.

In the method, according to a presently preferred embodiment, the contact lens wearer augments the sense of touch through the fingers by abrading them by any suitable means and applying the lenses using the wearer's sense of touch, either solely, if no mirror or other reflective means is available, or as a valuable aid to sight. Ideally, in a companion step, the user's fingers are washed conventionally with soap and water, but under emergency conditions washing facilities may not be available. In that event the abrasion cleaning step can provide a cleansing action (using water only, and without the use of liquid solvents or chemical cleaning agents) by removing oils and dead skin from the finger.

The means for rubbing the fingers to increase sensitivity may take the form of set and mounted bristles (cut to size as in a brush) or a roughened surface analogous to sand paper. Presently preferred in a brush are short, stiff bristles wherein the brush surface defines a trough to better engage the entire finger tip pads. This may be best achieved by forming the brush base in the shape of the trough desired wherein the bristles of equal length are embedded so that each bristle has the same value. Thus the sensitivity produced in the fingers by the brushing action should be equal.

BRIEF DESCRIPTION OF THE DRAWINGS

Turning now to the drawings in which the presently preferred embodiments of the invention are depicted.

DETAILED DESCRIPTION OF THE PREFERRED EMBODIMENT

Figure 1:
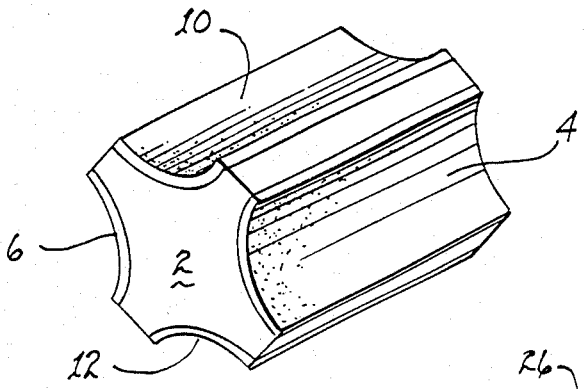
FIG. 1 is a perspective view of a first preferred embodiment.
Figure 5:
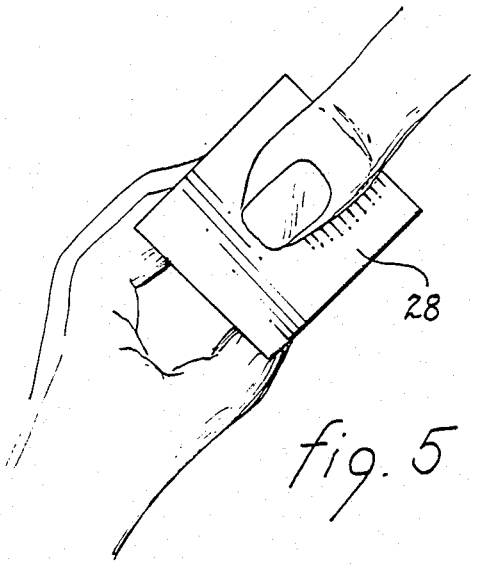
FIG. 5 shows the position of thumb and opposed finger in the use of the article.

Turning now to the drawings in which several presently preferred embodiments of the invention in an article of manufacturer are depicted, a first preferred embodiment is shown in FIG. 1 wherein a base 2 formed in the shape of an X (viewed in cross section) is provided on two opposed faces 4 and 6 with an abrasive layer of material 8 herein nylon fiber, such as Scotch Brite brand. This material is also available from DuPont. The faces 10 and 12 are provided with a similar rough surfaced material for the purpose of providing a gripping surface which can be engaged by the thumb and an opposing finger of the user as indicated in FIG. 5.

In use, the article of manufacture is held by the gripping surfaces 10, 12 with the fingers. The fingers that will be used to apply the lenses may be abraded by surfaces 4 and 6, followed by water rinse, which action serves not only to sensitize the fingers but also to remove oil and dead skin present on the fingers, either one of which can contaminate the surfaces of the lenses and cause deterioration of the lens material.

Figure 2:
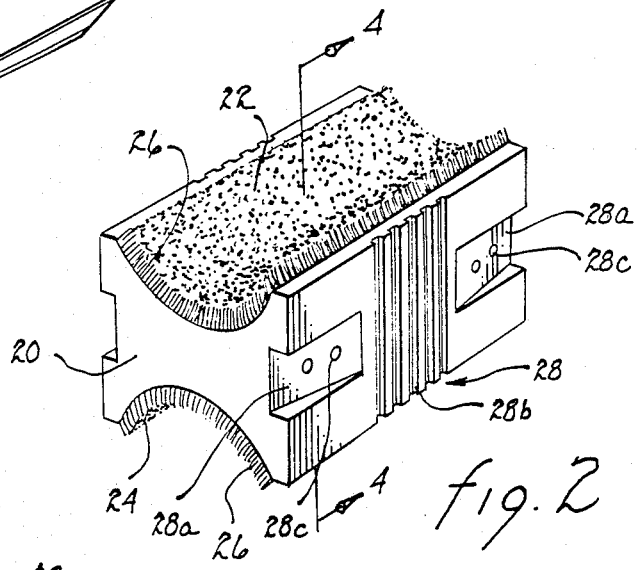
FIG. 2 is a perspective view of a second preferred embodiment.
Figure 4:
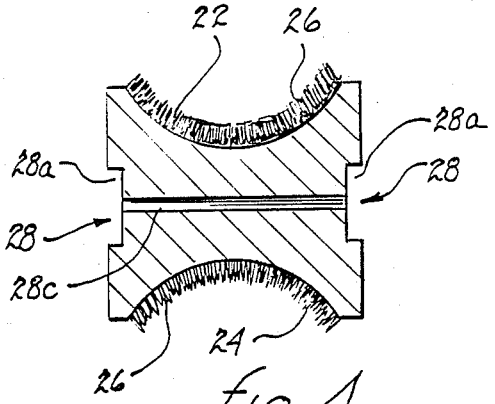
FIG. 4 is a cross section of FIG. 2 taken along the lines 4—4.

A second preferred embodiment is shown in FIGS. 2 and 4 wherein a block base 20 is shaped to define troughs 22, 24 in two opposing sides. Bristles 26 are set into the faces of troughs 22, 24 by means which are known to those skilled in the art of making brushes and which need not be set out in detail for that reason. The block 20, as shown in the embodiment of FIGS. 2 and 4, is shaped to define a cooperating ramp **28*a* and ridge 28*b* arrangement 28 to better engage the rounded pads of an opposed finger and thumb. The apertures 28*c*** are provided to assist in manufacturing and prevent surface deformation.

Figure 3:
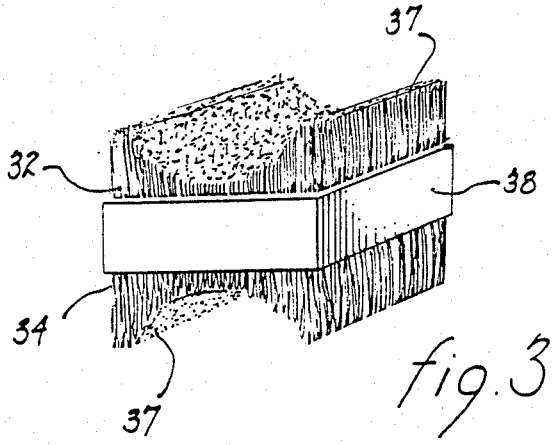
FIG. 3 is a perspective view of a third preferred embodiment.

In FIG. 3 yet another, less preferred embodiment is shown. Here the block base 30 has two flat faces, 32,34 in which bristles 36 are inserted. The bristle ends 37 are cropped to define the desired trough shape.

In each case in FIGS. 1 to 5 the base is provided with frictional gripping means indicated in said FIGS. as 10, 12, (FIG.1), 28 (FIGS. 2, 4) and 38 (FIG. 3).

Figure 6:
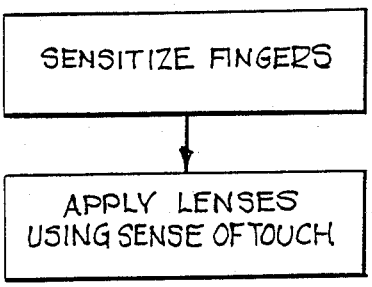
FIG. 6 is a schematic showing the basic steps of the process.

As indicated in FIG. 6, in operation the person applying the lenses sensitizes his fingers 40 and applies the lenses using the sense of touch 41, preferably using one of the articles of manufacture shown in FIGS. 1–5.

The embodiments shown are illustrative of the scope of the invention. From a consideration of this disclosure persons skilled in the art may readily see equivalent structures and embodiments that are within the spirit and scope of the invention.

What is claimed is:

1. In a method of inserting a contact lens in a human eye by hand, the steps comprising:

a. sensitizing the fingers; and b. applying the lens by sense of touch with the sensitized fingers.

2. The method of claim 1 with the additional step of washing the fingers involved.

3. The method of claim 1 wherein an abrasive material is used to sensitize the fingers.

4. The method of claim 3 wherein the abrasive material is a sanded paper.

5. The method of claim 3 wherein the abrasive material is nylon fiber.

6. The method of claim 3 wherein the abrasive material is a brush.

* * * * *